US005292026A

United States Patent [19]

Stolzman

[11] Patent Number: 5,292,026

[45] Date of Patent: Mar. 8, 1994

[54] SNAP-ON LID

[76] Inventor: Michael D. Stolzman, 1188 Old Colony Rd., Lake Forest, Ill. 60045

[21] Appl. No.: 863,349

[22] Filed: Mar. 31, 1992

Related U.S. Application Data

[63] Continuation of Ser. No. 696,362, May 6, 1991, abandoned.

[51] Int. Cl.[5] ..... B65D 43/06

[52] U.S. Cl. ..... 220/306; 220/277

[58] Field of Search ..... 220/306, 307, 319, 320, 220/321, 308, 277; 215/321

[56] References Cited

U.S. PATENT DOCUMENTS

| | | | |
|---|---|---|---|
| 3,610,306 | 10/1971 | Summers | 220/306 X |
| 3,811,597 | 5/1974 | Frankenberg et al. | 220/306 X |
| 4,165,018 | 8/1979 | Giggard | 220/284 |
| 4,177,930 | 12/1979 | Crisci | 220/284 |
| 4,305,535 | 12/1981 | Brundige et al. | 220/306 X |
| 4,346,816 | 8/1982 | Caille | 220/306 |
| 4,356,930 | 11/1982 | Roper | 220/306 |
| 4,421,244 | 12/1983 | Van Melle | 220/306 |
| 4,721,210 | 1/1988 | Lawrence et al. | 220/306 X |
| 4,881,658 | 11/1989 | Van Cucha | 220/306 |
| 4,905,861 | 3/1990 | Boxall et al. | 220/266 |

*Primary Examiner*—Allan N. Shoap
*Assistant Examiner*—Nova Stucker
*Attorney, Agent, or Firm*—Wood, Phillips, VanSanten, Hoffman & Ertel

[57] ABSTRACT

A closure is used with a container having an annular end portion defining a radially outwardly opening annular recess. The closure comprises a generally circular closure wall, a generally cylindrical continuous sidewall having an upper edge connected to the closure wall and a continuous annular lower edge. The sidewall has an inner diameter slightly greater than the outer diameter of the container annular end portion, and a radially inwardly extending ridge on an inside of the sidewall between the upper and lower ridges. The ridge has an inner diameter less than the container annular end portion outer diameter yet greater than an outer diameter of the annular recess so that when the closure is installed on the container at least one of the container end portion and the sidewall is temporarily deformed to permit reception of the ridge in the recess to lock the closure on the container.

13 Claims, 2 Drawing Sheets

SNAP-ON LID

This application is a continuation of application Ser. No. 696,362, filed May 6, 1991.

FIELD OF THE INVENTION

This invention relates to containers and, more particularly, to a self-locking closure or lid for use with a container.

In one form of conventional shipping and storage container, a tubular side wall is formed of fibrous Material or other material. It is conventional to provide metal securing rings at opposite ends of the side wall for securing closure walls thereacross. Such metal securing rings are relatively costly and heavy and are not fully satisfactory in the formation of a low cost shipping and storage container.

An alternative to such prior closures is described in my U.S. Pat. No. 4,805,798 which discloses a container and closure having fastening means in the form of a threaded connector or a lockable lever.

In certain applications,, such as disposal of hazardous waste, it is desirable that a closure not be removable. Particularly, with hazardous waste a drum with a closure is sent into an incinerator for destruction. The use of any of the above-described securing apparatus is unnecessary in such situations. Further, if a metal cover or retaining ring is used, then it is necessary to ultimately remove the metal from the incinerator.

The present invention is directed to solving one or more of the problems discussed above in a novel and simple manner.

SUMMARY OF THE INVENTION

In accordance with the invention there is disclosed a self-locking closure for use with a container.

Broadly, the closure is used with a container having an annular end portion defining a radially outwardly opening annular recess. The closure comprises a generally circular closure wall, a generally cylindrical continuous sidewall having an upper edge connected to the closure wall and a continuous annular lower edge. The sidewall has an inner diameter slightly greater than the outer diameter of the container annular end portion, and a radially inwardly extending ridge on an inside of the sidewall between the upper and lower ridges. The ridge has an inner diameter less than the container annular end portion outer diameter yet greater than an outer diameter of the annular recess so that when the closure is installed on the container at least one of the container end portion and the sidewall is temporarily deformed to permit reception of the ridge in the recess to lock the closure on the container.

It is a feature of the invention that the closure is formed of molded synthetic resin.

It is a further feature of the invention to provide a plurality of circumferentially spaced openings through the sidewall disposed between the ridge and the upper edge.

It is a further feature of the invention that the sidewall includes a plurality of circumferentially spaced trim portions of a first select wall thickness and a remainder of the sidewall is of a second select wall thickness greater than the first select wall thickness.

It is yet another feature of the invention that the sidewall includes a radially outwardly opening annular recess coaxial with the ridge.

It is still a further feature of the invention that the sidewall radially outwardly opening annular recess includes a plurality of circumferentially spaced, longitudinally extending reinforcement ribs therein.

In accordance with another aspect of the invention there is disclosed a self -locking closure for use with a container having an annular end portion defining a radially outwardly opening annular recess. The closure comprises a unitary cover including a generally circular closure wall, a generally cylindrical, continuous sidewall having an upper edge connected to the closure wall and a continuous annular lower edge positioned downwardly from the annular recess, in use. The sidewall has an inner diameter slightly greater than an outer diameter of the container annular end portion, and a radially inwardly extending ridge on an inside of the sidewall between the upper and lower edges. The ridge has an inner diameter less than the container annular end portion outer diameter yet greater than an outer diameter of the angular recess so that when the closure is installed on the container at least one of the container end portion and the sidewall is temporarily deformed to permit reception of the ridge in the recess to lock the closure on the container.

Further features and advantages of the invention will readily be apparent from the specification and from the drawings.

DETAILED DESCRIPTION OF THE INVENTION

Figure 1:
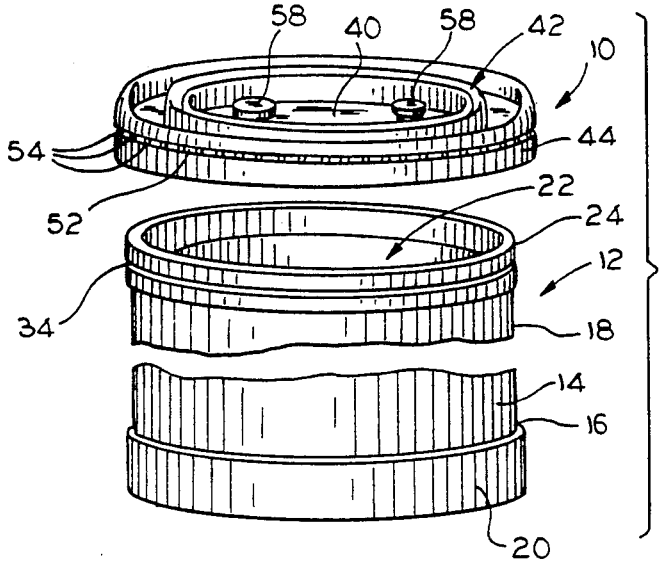
FIG. 1 is a fragmentary exploded view of a container and self-locking closure according to the invention.
Figure 2:
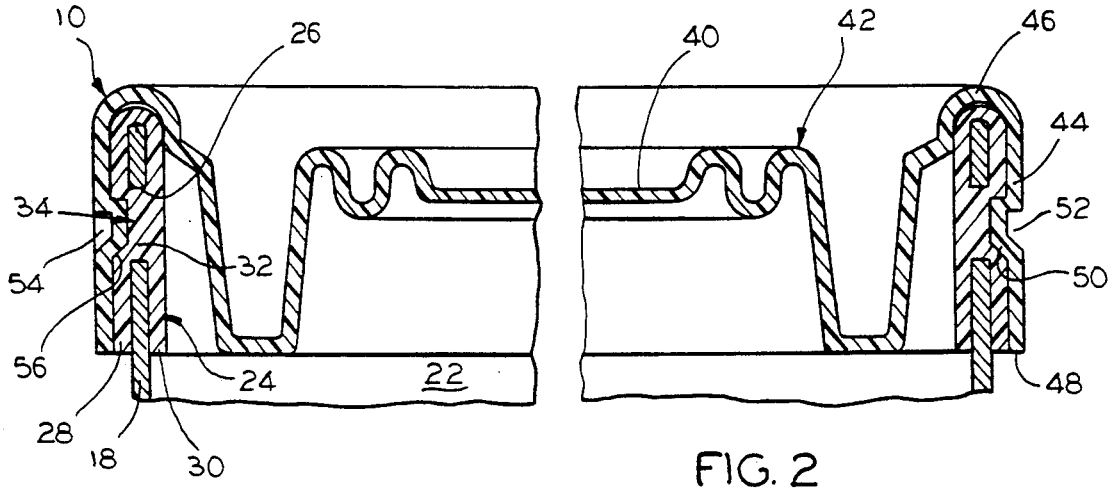
FIG. 2 is a fragmentary sectional view of the closure of FIG. 1 mounted on the container.
Figure 3:
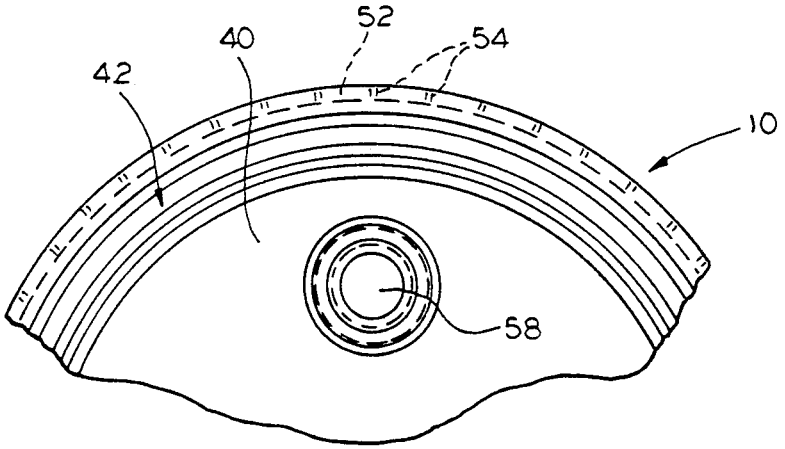
FIG. 3 is a partial plan view of the closure of FIG. 1.
Figure 4:
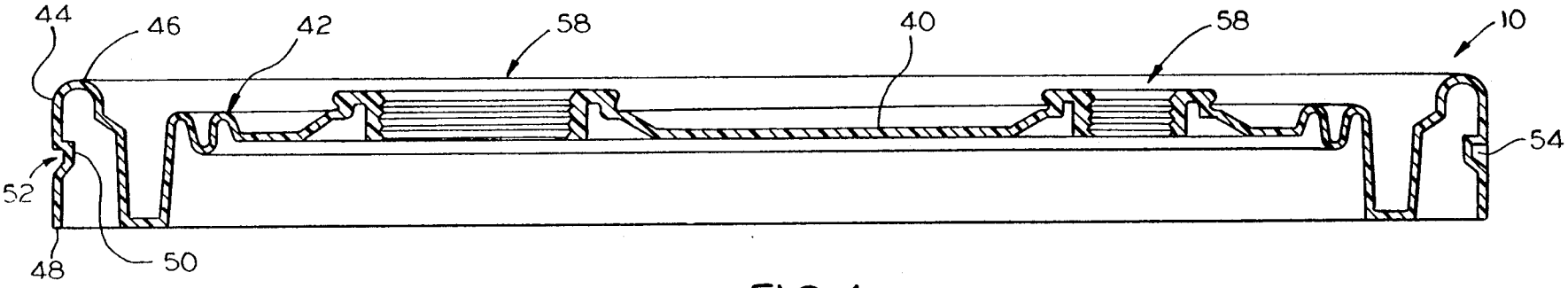
FIG. 4 is a sectional view of the closure of FIG. 1.

In a first embodiment of the invention, as illustrated in FIGS. 1–5 of the drawing, a self-locking closure 10 is shown for use with a container 12. The container 12 includes a fibrous, tubular sidewall 14. In the illustrated embodiment, the sidewall 14 defines a right cylinder, it being understood that the sidewall may define other configurations, such as square, oval, etc.

The sidewall 14 has a lower end portion 16 and an upper end portion 18. The lower end portion 16 is closed by a closure generally designated 20 fixedly secured to the sidewall lower end portion 16, as seen in FIG. 1. The tubular sidewall 14 and closure 20 define an internal storage space 22. The open upper end of the space 22 is selectively closed by the closure 10 securable to a connecting ring 24 fixedly secured to the sidewall upper end portion 18.

The bottom closure 20 comprises a unitary element molded of a suitable synthetic resin, such as high density polyethylene. The closure 20 is molded in situ in association with the sidewall lower end portion 16.

The connecting ring 24 is molded of synthetic resin in situ in association with the sidewall upper end portion 18. More specifically, the sidewall upper end portion 18 is provided with an array of through openings 26, see FIG. 2. The connecting ring 24 defines a pair of legs 28 and 30 joined by a connecting portion 32 extending through the openings 26. The connecting ring 24 is preferably molded in situ to the tubular side wall upper end portion 18 as by injection molding so as to secure the connecting ring 24 in sealed, clamped association.

The connecting ring 24 further includes a peripheral, radially outwardly opening annular recess 34 having an outwardly widening trapezoidal cross-section.

Although in the illustrated embodiment, the container 12 includes a fibrous sidewall 14 and molded closure 20 and retaining ring 24, alternative constructions could be utilized in connection with the closure 10 of the invention. Indeed, the particular form of the container 12 may be chosen by necessity except for the requirement that the container 12 include a radially outwardly opening annular recess such as the recess 34 shown in FIGS. 1 and 2.

The top closure 10 is of unitary construction and in the illustrated embodiment is injection molded of a suitable synthetic resin. The closure 10 includes a generally circular closure wall 40. The closure wall 40 includes indentations defining circular rings 42 to maintain the flatness of the closure wall 42 when it is molded and to act as an accordion pressure release if the container 14 tips over.

A generally cylindrical, continuous sidewall 44 has an upper edge 46 connected to the closure wall 40 and a continuous annular lower edge 48 positioned downwardly from the retaining ring annular recess 34, in use. The closure sidewall 48 has an inner diameter slightly greater than an outer diameter of the container retaining ring 24. The side wall 44 also includes a radially inwardly extending continuous ridge 50 on an inside of the sidewall 44 between the upper edge 46 and lower edge 48. The ridge 50 has an inner diameter less than the container retaining ring outer diameter yet greater than an outer diameter of the retaining ring annular recess 34. To facilitate molding, and provide uniform closure wall thickness, the sidewall 44 includes a radially outwardly opening annular recess 52 coaxial with and corresponding to the position of the ridge 50. A plurality of circumferentially spaced, longitudinally extending reinforcement ribs 54 are contained in the recess 52.

The sidewall inner ridge 50 is of inwardly narrowing trapezoidal cross-section corresponding to that of the retaining ring annular recess 34 and includes a diagonal lower wall portion 56. To cover the container 12, the closure 10 is positioned above the container 12 as illustrated in FIG. 1. The closure 10 is then lowered so that the sidewall 44 below the ridge 50 rests atop the container retaining ring 24. When a downward pressure is applied at the sidewall upper edge 46 the diagonal lower wall portion 56 acting on the retaining ring upper edge facilitates downward movement and, specifically, either the container upper end portion 18 or the sidewall 44 is temporarily deformed to permit reception of the ridge 50 in the retaining ring annular recess 34 to lock the closure 10 on the container 12. Once installed, an upper edge of the ridge 50 is effectively locked against an upper edge of the recess 34 to prevent removal. Since the sidewall lower edge 48 is continuous the closure 10 is virtually impossible to remove without destroying the same.

In order to facilitate providing access to the space 22, if necessary, the closure may include one or more spout openings 58 selectively closed by suitable caps (not shown).

Figure 6:
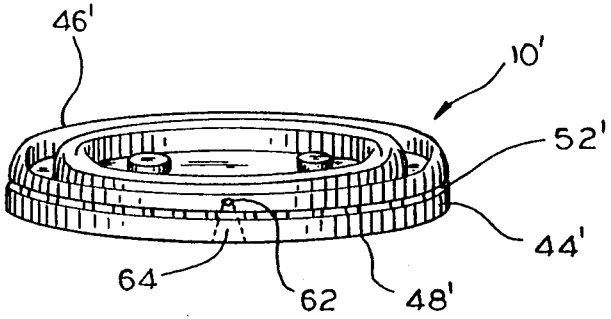
FIG. 6 is a perspective view of a closure according to an alternative embodiment of the invention.
Figure 5:
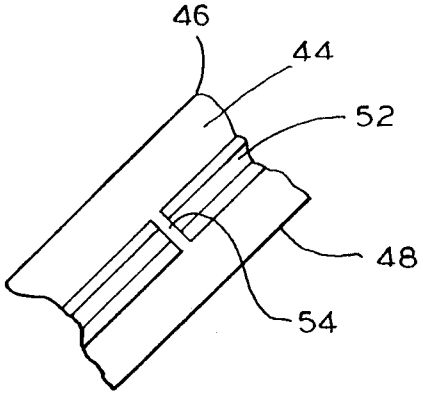
FIG. 5 is a fragmentary enlarged view illustrating an outer annular recess of the closure of FIG. 1.

The closure 10, discussed above, is suitable for applications where it is intended to be used one time only. It is also desirable to have a closure of a self-locking nature as described that can be reusable. With reference to FIG. 6, a closure 10' according to an alternative embodiment of the invention is illustrated. The closure 10' is virtually identical to the closure 10 discussed above. For simplicity like elements are referenced with like, prized reference numerals. The principal difference between the closure 10 and the closure 10' lies in the addition of a plurality of circumferentially spaced openings 62 through the sidewall 44' disposed between the annular recess 52' and the sidewall upper edge 46'. These openings 62 provide a position where the sidewall 44' can be slit by inserting a knife or other implement in the openings 62 and slitting downwardly to the lower edge 48'.

To further facilitate removal, the sidewall 44' includes a plurality of circumferentially spaced trim portions 64 which are of triangular configuration having an apex at the openings 62. The trim portions 64 are of a first select wall thickness. The remainder of the sidewall 44' is of a second select wall thickness, greater than the first select wall thickness. The lesser wall thickness provides a wall that can be more easily cut by a knife or other instrument.

Once the closure 10' has been cut for removal, it can easily be reinstalled, although the self -locking affect is not as secure as the closure 10' no longer has a continuous lower edge 48'. However, a suitable plastic band or other retaining device can be placed around the sidewall 44' for securing the same. Indeed, such a band can include inwardly directed cleats which act upon the ridges 54 to maintain the same in proper orientation.

Thus, in accordance with the invention, there is disclosed a unitary self-locking closure having a continuous sidewall with an inwardly extending annular ridge receivable in a radially outwardly opening annular recess in a container.

I claim:

1. A self locking closure for use with a container having a cylindrical end portion defining a radially outwardly opening annular recess having an upper edge defining a right angle shoulder, said closure comprising:

a generally circular closure wall;

a generally cylindrical, continuous sidewall having an upper edge connected to said closure wall and a continuous annular lower edge, in use, said sidewall defining a cylindrical inner surface having an inner diameter slightly greater than an outer diameter of said container cylindrical end portion to provide a sealed fit therebetween;

a radially inwardly extending ridge on an inside of said sidewall contiguous for substantially 360° with the inside of the sidewall between said upper and lower edges, in use, said ridge having an inner diameter less than said container annular end portion outer diameter yet greater than an outer diameter of said annular recess, so that when said closure is installed on said container at least one of said container end portion and said sidewall is temporarily deformed to permit reception of said ridge in said recess to lock said closure on said container, said ridge having an upper annular planar surface defining a shoulder locking against said recess shoulder to effectively prevent removal of the closure; and a radially outwardly opening annular recess on an outside of said sidewall axially aligned with said ridge between said upper and lower edges, wherein said sidewall radially outwardly opening annular recess includes a plurality of circumferentially spaced, longitudinally extending reinforcement ribs therein.

2. The self locking closure of claim 1 wherein said closure is formed of molded synthetic resin.

3. The self locking closure of claim 1 further comprising a plurality of circumferentially spaced openings through said sidewall disposed between said ridge and said upper edge.

4. The self locking closure of claim 1 wherein said sidewall includes a plurality of circumferentially spaced trim portions of a first select wall thickness and the remainder of said sidewall is of a second select wall thickness greater than said first select wall thickness.

5. A self locking closure for use with a container having a cylindrical end portion defining a radially outwardly opening annular recess having an upper edge defining a right angle shoulder, said closure comprising:

a unitary cover including a generally circular closure wall, a generally cylindrical, continuous sidewall having an upper edge connected to said closure wall and a continuous annular lower edge, in use, said sidewall defining a cylindrical inner surface having an inner diameter slightly greater than an outer diameter of said container annular end portion to provide a sealed fit therebetween, and a radially inwardly extending ridge on an inside of said sidewall continuous for substantially 360° with the inside of the sidewall between said upper and lower edges, in use, said ridge having an inner diameter less than said container annular end portion outer diameter yet greater than an outer diameter of said annular recess, so that when said closure is installed on said container at least one of said container end portion and said sidewall is temporarily deformed to permit reception of said ridge in said recess to lock said closure on said container, said ridge having an upper annular planar surface defining a shoulder locking against said recess shoulder to effectively prevent removal of the closure; and a radially outwardly opening annular recess on an outside or said sidewall axially aligned with said ridge, wherein said sidewall radially outwardly opening annular recess includes a plurality of circumferentially spaced, longitudinally extending reinforcement ribs therein.

6. The self locking closure of claim 5 wherein said closure is formed of molded synthetic resin.

7. The self locking closure of claim 5 further comprising a plurality of circumferentially spaced openings through said sidewall disposed between said ridge and said upper edge.

8. The self locking closure of claim 5 wherein said sidewall includes a plurality of circumferentially spaced trim portions of a first select wall thickness and the remainder of said sidewall is of a second select wall thickness greater than said first select wall thickness.

9. A self locking closure for use with a container having a cylindrical end portion defining a radially outwardly opening annular recess, the closure comprising:

a generally circular closure wall;

a generally cylindrical, continuous sidewall having an upper edge connected to said closure wall and a continuous annular lower edge, in use, said sidewall having an inner diameter slightly greater than an outer diameter of said container end portion;

said sidewall being formed to include a radially inwardly extending ridge and corresponding radially outwardly opening annular recess contiguous for substantially 360° with the sidewall between said upper and lower edges, in use, said ridge having an inner diameter less than said container annular end portion outer diameter yet greater than an outer diameter of said annular recess, so that when said closure is installed in said container, at least one of said container end portion and said sidewall is temporarily deformed to permit reception of said ridge in said recess to lock said closure on said container; and a plurality of circumferentially spaced, longitudinally extending reinforcement ribs in said sidewall radially outwardly opening annular recess.

10. The self locking closure of claim 9 further comprising a plurality of circumferentially spaced openings through said sidewall disposed between said ridge and said upper edge.

11. The self locking closure of claim 9 wherein said sidewall includes a plurality of circumferentially spaced trim portions of a first select wall thickness and the remainder of said sidewalls of a second select wall thickness greater than said first select wall thickness.

12. The self locking closure of claim 9 wherein said closure is of unitary construction.

13. The self locking closure of claim 12 wherein said closure is formed of molded synthetic resin.

* * * * *